US008696346B2

(12) United States Patent
Chahal

(10) Patent No.: US 8,696,346 B2
(45) Date of Patent: Apr. 15, 2014

(54) COUNTERBAND TAPE

(75) Inventor: Vinod Kumar Chahal, East Amherst, NY (US)

(73) Assignee: Habasit AG, Reinach (CH)

( * ) Notice: Subject to any disclaimer, the term of this patent is extended or adjusted under 35 U.S.C. 154(b) by 618 days.

(21) Appl. No.: 12/026,920

(22) Filed: Feb. 6, 2008

(65) Prior Publication Data

US 2009/0197493 A1 Aug. 6, 2009

(51) Int. Cl.
*F26B 13/10* (2006.01)
*D03D 13/00* (2006.01)
*D06B 3/04* (2006.01)

(52) U.S. Cl.
USPC ..... 425/404; 425/72.1; 425/84; 425/384; 425/506; 425/508; 139/383 R; 139/392; 139/404; 139/440; 442/199; 442/203; 442/301; 28/122; 28/165; 28/166; 428/365; 428/222; 428/107; 19/296

(58) Field of Classification Search
USPC ..... 428/364, 365, 105, 107, 193, 222, 419, 428/902; 139/383 A, 383 AA, 383 R, 384 R, 139/390, 426 R, 440, 392, 404, 408; 425/86, 425/89, 383, 392, 404, 506, 508, 72.1, 84, 425/384, DIG. 245; 19/296, 297, 299; 442/199, 301, 398, 203; 28/107, 122, 28/166, 165, 217
See application file for complete search history.

(56) References Cited

U.S. PATENT DOCUMENTS 2,513,188 A * 6/1950 MaCallum ..... 528/389
3,354,129 A * 11/1967 Edmonds, Jr. et al. ..... 528/265
3,895,091 A * 7/1975 Short et al. ..... 264/210.6
3,912,695 A * 10/1975 Short et al. ..... 528/388
4,423,543 A * 1/1984 Leuvelink ..... 29/433
4,454,189 A * 6/1984 Fukata ..... 428/339
4,610,916 A * 9/1986 Ballard ..... 442/189
4,748,077 A * 5/1988 Skinner et al. ..... 442/199
4,755,420 A * 7/1988 Baker et al. ..... 428/222
4,786,554 A 11/1988 Baker et al.
4,792,662 A * 12/1988 Kitagaki et al. ..... 219/545
4,801,492 A * 1/1989 Skinner et al. ..... 442/199
5,089,207 A 2/1992 Hammond et al.
5,162,151 A * 11/1992 Smith et al. ..... 428/364
5,244,718 A * 9/1993 Taylor et al. ..... 442/208
5,424,125 A * 6/1995 Ballard et al. ..... 428/364
5,433,998 A 7/1995 Curzio et al.
5,456,973 A * 10/1995 Ballard et al. ..... 442/199
5,464,685 A 11/1995 Fry
5,496,625 A * 3/1996 Lilani ..... 442/190
5,562,968 A * 10/1996 Fry ..... 428/193
5,565,283 A 10/1996 Chalasani et al.
5,981,408 A 11/1999 Nakagawa et al.
6,470,994 B1 10/2002 Shimizu et al.
7,108,019 B2 9/2006 Nagura et al.

(Continued)

FOREIGN PATENT DOCUMENTS

FR 2 870 222 A1 11/2005
WO WO 01/28896 A1 4/2001
WO WO 2004/037683 A2 5/2004

*Primary Examiner* — Seyed Masoud Malekzadeh
(74) *Attorney, Agent, or Firm* — Hodgson Russ LLP

(57) ABSTRACT

A counterband tape for use in the heat setting tunnel of a carpet yarn heat setting machine. The tape is constructed from polyphenylene sulfide yarns. The counterband tape may be formed as a single layer woven fabric with a twill weave construction. The tape also may include a herringbone pattern.

6 Claims, 4 Drawing Sheets

(56) References Cited

U.S. PATENT DOCUMENTS

| | | | |
|---|---|---|---|
| 7,114,529 | B2 | 10/2006 | Johnson et al. |
| 7,121,306 | B2 | 10/2006 | Harrison |
| 7,216,677 | B2 | 5/2007 | Fujisawa |
| 7,216,678 | B2 | 5/2007 | Baer |
| 2002/0106510 | A1 | 8/2002 | Deguchi et al. |
| 2003/0082973 | A1 | 5/2003 | Yamamoto et al. |
| 2004/0166282 | A1 | 8/2004 | Kingsford et al. |
| 2004/0182466 | A1 | 9/2004 | Johnson et al. |
| 2005/0164588 | A1 | 7/2005 | Sodemann et al. |
| 2005/0229995 | A1 | 10/2005 | Ito et al. |
| 2006/0014463 | A1 | 1/2006 | Yoshida |
| 2006/0016507 | A1 | 1/2006 | Baer |
| 2006/0121276 | A1 | 6/2006 | Breuer |
| 2007/0095417 | A1 | 5/2007 | Fujisawa |
| 2007/0161309 | A1 | 7/2007 | Villeneuve |
| 2008/0005877 | A1 | 1/2008 | Laird et al. |

* cited by examiner

Figure 3: 8-End, Pointed Twill Weave Design
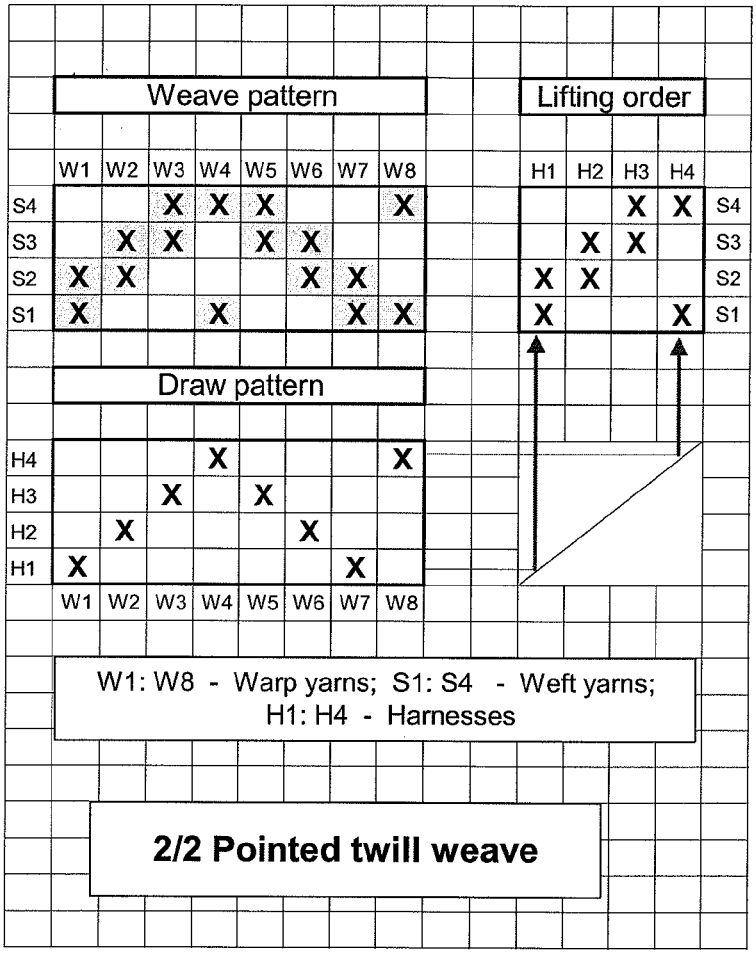

Figure 4: 8-End, Herringbone Twill Weave Design
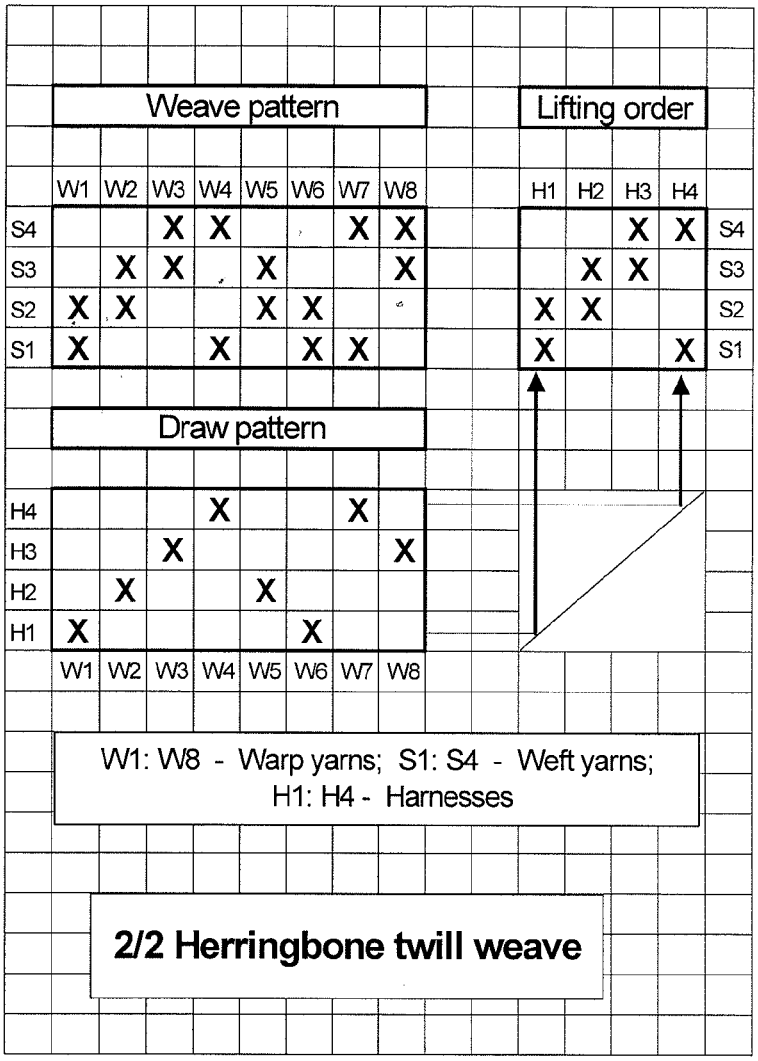

COUNTERBAND TAPE

FIELD OF THE INVENTION

The present invention relates generally to the heatsetting of carpet yarns and specifically to a counterband tape for use in the continuous heatsetting of polyester carpet yarns.

BACKGROUND OF INVENTION

In the heat setting of carpet yarns, the yarns are typically laid on a stainless steel conveyor belt and a textile product lays on top of the yarns to hold them in place. This textile product is called a counterband tape. Continuous carpet yarn heat setting machines are commercially available and one supplier is Superba S.A., Mulhouse, France. Some counterband tapes have previously been manufactured from yarns made of the material polymetaphenylene isophthalamide which is commercially available from DuPont under the brand name NOMEX (m-aramid). In the carpet yarn making industry for heat-setting of yarns on SUPERBA brand machines, NOMEX (Meta-aramid fiber available from DuPont) is the raw material of choice for making counterband tapes due to its high temperature resistance. As the working temperature for the tape application increases, the preferred polymer selection is one that can withstand elevated temperatures without heat and hydrolytic degradation due to the combination of heat and moisture. Counterband tapes currently being used in the industry are generally made of polyester and NOMEX yarns. There are a few examples of KEVLAR and TECHNORA (para-Aramid) observed in limited field trials. Due to a wide range of working temperatures applicable in the heat tunnels on Superba machines, the life of the counterband tape is highly dependent on the working temperatures in the application. When the heat tunnel is set at a lower working temperature, the counterband tapes last longer. At the lower end of working temperatures, the end user also has more options in the selection of counterband tapes made with different types of polymers that have lower heat resistance properties than NOMEX. However, as the tunnel working temperature range is increased, the life expectancy of the counterband tape deteriorates rapidly. The heat setting equipment manufacturers typically recommend NOMEX counter band tape at the highest range of tunnel temperatures for heat setting polyester (PET, polyethylene terephthalate) yarns. The NOMEX counterband tape life is extremely limited at the highest end of the tunnel temperature settings as observed in various field runs. Meta-aramid polymer degrades at accelerated rates due to hydrolytic damage at the higher tunnel temperatures. The extent of polymer degradation and weight loss found was significant and rendered the counterband tape ineffective in carrying out the heat and moisture transfer during the normal cycle on the carpet yarn heat setting machines after a few weeks of use.

For nylon carpet yarns which are a lower working temperature material, the NOMEX brand material performed satisfactorily in the counterband tape application. However, the heatsetting temperatures for polyester are higher (i.e., 145° C. in the tunnel section) than for nylon, and as described above the NOMEX material was not as durable under the higher working temperatures. Accordingly, there is a need for a counterband tape for use in the continuous heatsetting of carpet yarns where the yarns are heatset at the higher temperatures suitable for polyester yarns. There is also a need for a tape with a surface texture optimized for use in the heatsetting application.

SUMMARY OF INVENTION

The present invention meets the above-described needs by providing a counterband tape constructed from polyphenylene sulfide (PPS) yarns. The counterband tape may be formed as a single layer woven fabric with a twill weave construction. The tape may include a herringbone pattern.

BRIEF DESCRIPTION OF THE DRAWINGS

The invention is illustrated in the drawings in which like reference characters designate the same or similar parts throughout the figures of which:

FIG. 3 is a weave diagram for a 2/2 pointed twill weave with an 8-end repeat;

FIG. 4 is a weave diagram for a 2/2 herringbone twill weave with an 8-end repeat.

DETAILED DESCRIPTION OF THE INVENTION

Figure 1A:
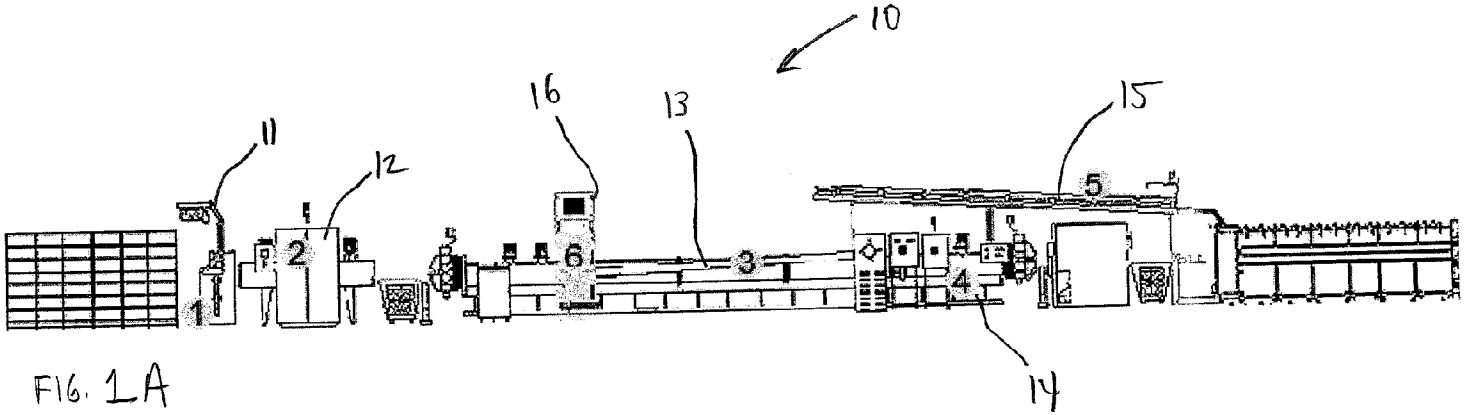
FIG. 1A is a schematic diagram of a continuous carpet yarn heat-setting machine.
Figure 1B:
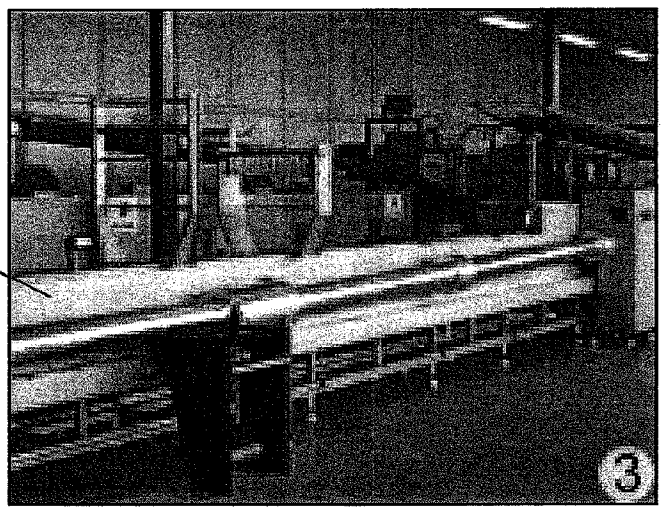
FIG. 1B is a detailed view of the tunnel section.

In FIG. 1, a continuous carpet yarn heat-setting system is shown. Plied and twisted carpet yarn twist is permanently set within the yarn through application of heat and saturated steam inside the heat tunnel 13 of a carpet yarn heat setting system 10. The heat-setting system 10 is continuously fed by a creel equipped with bobbins. A multiple array of carpet yarns are unwound from the creel and laid loosely in parallel oval spirals crosswise on a perforated stainless steel endless conveyor belt by a screw laying head 11. The stainless steel conveyor belt is arranged in an endless loop and carries the yarns through the heat setting tunnel 13. The stainless steel conveyor belt has a support surface that typically has a width of approximately twelve inches, and the typical counterband tape width for this size belt is approximately 178 mm (seven inches).

The yarns are first processed in a pre-steamer 12. The pre-steamer 12 operates at normal atmospheric pressure and transfers heat and moisture into the yarns thus enabling conditioning and swelling of the yarns. The fleece then goes in a cooler (not shown) before entering the pressurized heat-setting tunnel 13.

The endless stainless steel conveyor carries the yarns into a pressurized heat setting steam tunnel 13. The high heat and moisture within the heat tunnel 13 permanently sets the yarn twist. At the entry and exit ends of the heat tunnel 13, small rectangular openings or slots enable the yarns to pass into the chamber. The heat tunnel 13 is pressurized up to 5 bars (atmospheric pressure) with superheated steam. Precise temperature control is maintained within the heat tunnel through a PLC 16, temperature sensors and controllers. In the heat-setting tunnel 13, pure saturated steam under pressure at a high temperature (up to 150° C.) delivers a thermal shock to the yarn that results in permanently setting the curling twist, volume and molecular structure of the fibers and the yarns. To prevent steam and heat loss, specially designed nip roller assemblies also called tightening heads are used at the entry and exit points of the heating tunnel 13. In order to prevent slippage of loosely held yarns at the nips, a tape cover on the top is provided for sandwiching the layer of yarns between the top surface of the stainless steel belt and the tape cover. Accordingly, the counterband belt or tape cover of the present invention is placed over the yarns to hold them in position on the stainless steel belt as they are conveyed through the heat-setting tunnel 13 of the carpet yarn heat-setting machine 10. At the exit end of the heat setting tunnel 13, the yarns are cooled rapidly in a turbo cooling chamber 14 bringing down the yarn temperature by 40 to 50° C. In the final stage an accumulator 15 takes up the permanently heat set yarns.

The temperature setting of the heat tunnel 13 is maintained at a level that is appropriate for the composition of the yarn being heat-set. The manufacture of the heat setting equipment 10 provides these setpoints for various synthetics and natural fibers.

When the counterband tape exits from the tunnel 13, it is hot and wet from interaction with superheated steam inside the heat tunnel 13. The tape then rapidly cools down in the cooling chamber 14 and exits the heat setting machine 10 at hotter than ambient air temperatures. It comes to near ambient temperatures before it re-enters the tunnel 13 in the second half of the machine cycle. The counterband tape continually undergoes heat cycles with temperatures fluctuating between the heat tunnel 13 set point and near ambient temperatures. Between and within these heat cycles, the counterband tape is wet at all times.

To withstand hydrolytic damage from elevated temperatures (145° C.) of the heat tunnel 13 with water vapor at 70 psi, polyphenylene sulfide (PPS) was selected for the tape of the present invention due to its chemical inertness and its resistance to hydrolysis under the superheated conditions of the carpet yarn heatsetting application. PPS is a linear, inorganic, heat resistant polymer with working temperatures of up to 190° C. (lower than the Meta-aramid working temperature). PPS also has excellent vapor heat resistance (in the presence of both heat and moisture) as compared to Meta-aramid and retains 90% of its strength at 160° C. in autoclave at 98 psi for more than 144 days.

Counterband tapes are designed to have length and width dimensions to fit the heat setting machines (such as the Superba machines) as per the O.E.M.'s required specifications. The heat setting machines are designed for various widths and lengths depending on several design factors, i.e., yarn fineness; type of yarn; size of creel and speed of the machine; and the generation (age) of the machine. The counterband tape is manufactured to the required width needed on the heatset tunnel. The tape is applied on the heat setting machine in an endless loop after it is joined (spliced) by the end user. Some ranges of widths that are commonly used in the U.S. carpet yarn industry include: 76 mm; 178 mm; 209 mm; and 248 mm. Other widths may also be suitable for different applications and heat setting machines.

The counterband tape thickness typically ranges from 1 mm to 2 mm. The thickness of the tape dictates its areal mass density (mass/unit area, used in comparison of planar structures), its heat capacity and its air permeability (breathability to air or vapors). A thicker counterband tape is heavier, can absorb more heat and moisture, is less permeable for vapor transfer, and requires more energy to transport on the heat-set line. The tape should be compressible to some degree so that it can go through the nips and form seals at the entry and exit points in the heat tunnel. The tape should be able to recover its thickness when the nip pressure is released.

The counterband tape works under heat and moisture continuously in cycles between high heat and ambient room temperatures throughout its lifecycle. Dimensional stability of the tape is highly desired from the time of installation to the end of the tape life. Changes in any of the tape dimensions directly impact the run ability of the tape thus shortening the useful life of the counterband tape. To minimize the adverse affects of operating conditions (high moisture and heat) on the physical dimensions of the tape, the tape is pre-heatset (before it is applied) well above the operating temperatures experienced in the heating tunnel. Thermal fixation of the polymer in the heatset process is undertaken with the following objectives: (a) removal of residual stress built-up within the woven fabric; (b) facilitation of crimp interchange between the warp and weft yarns; (c) allowance of thermal shrinkage of the polymer (thermal stability); and (d) setting the tape structure to achieve dimensional stability.

The counterband tape works as an endless belt and moves in a linear path. It should not waver or move off-track sideways as this would cause the tape to hit an obstruction or to become jammed in the machine. The tape runs under low applied tensile loads. On its return path, the applied loads are even smaller. To facilitate easier tracking of the tape (especially under low applied load conditions), the tape surface is constructed with deep diagonal grooves that zigzag in alternating directions at equally spaced intervals along the width of the tape. This type of surface is a derivative of broken twill weave and in weaving terminology is also called a herringbone pattern or pointed twill pattern. Such a textured surface is very conducive to even distribution of frictional forces between the counterband tape and the loosely placed yarns on the stainless steel perforated conveyor. Slippage between the counterband tape and the yarns on which it lays is minimized due to the reversal of the diagonal twill patterns.

Figure 2:
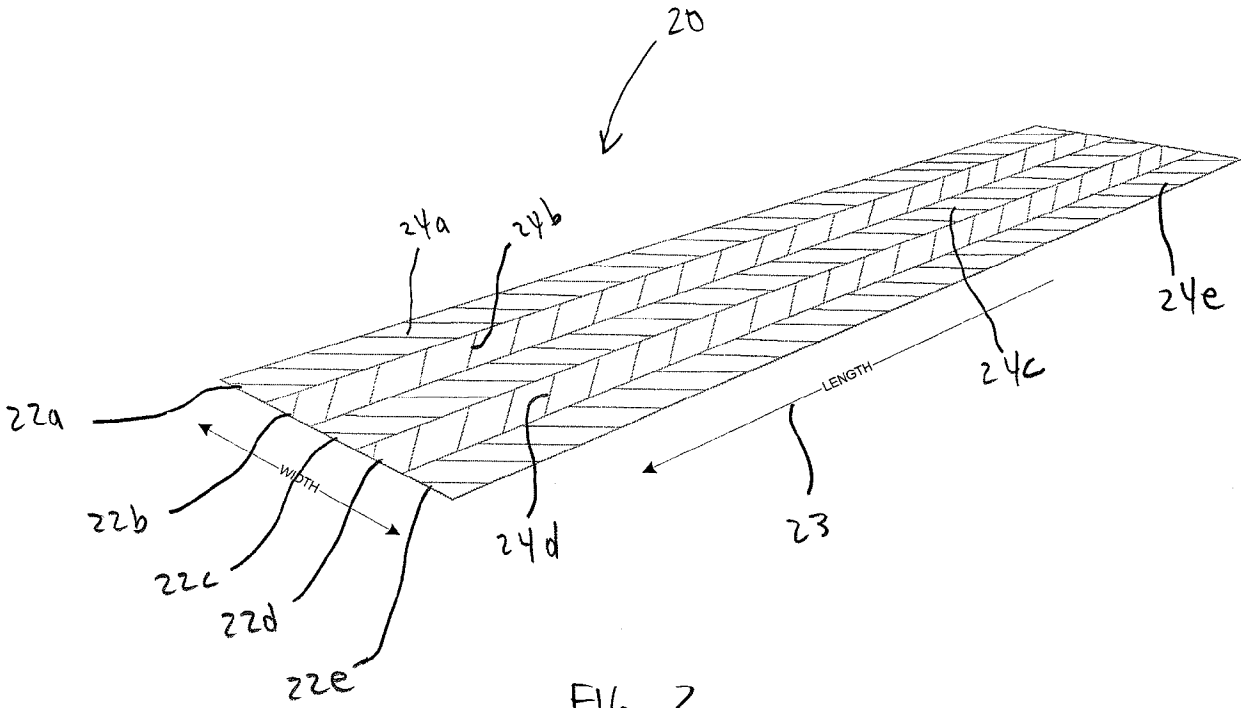
FIG. 2 is a perspective view of a portion of the counterband tape of the present invention.

Turning to FIG. 2, an example of a balanced 2/2 broken twill weave with a herringbone pattern is illustrated. The tape 20 has five rows 22*a*, 22*b*, 22*c*, 22*d*, and 22*e* oriented in the machine direction, which is indicated by arrow 23. The rows may be approximately one inch or 25.4 mm wide. As shown adjacent rows 22*a* and 22*b* have strands 24*a-e* that are angled equal and opposite to each other in zig zag fashion. The pattern is also referred to as herringbone. As will be evident to those of ordinary skill in the art based on this disclosure, a similar type of surface texture can also be woven using other types of weaves, e.g., broken twill weave, matte weave. Alternate weaves to the twill weave can also be considered i.e., plain weave, warp or weft rib weaves. Other weave patterns may also be suitable as will be evident to those of ordinary skill in the art based on this disclosure.

The counterband tape of the present invention has many advantages over existing counterband tapes including higher performance, longer life expectancy, and improved productivity in the heat setting tunnels. The most significant improvements were observed in applications where polyester yarns were processed in carpet yarn heatsetting machines at the highest set point temperatures.

The high temperature polyphenylene sulfide (PPS) flat woven counterband tape of the present invention is high temperature resistant, high tensile modulus, and can work under wet or dry conditions. PPS is an inorganic polymer that resists damage from hydrolysis (heat under wet conditions) and retains its physical properties during the complete belt life cycle. PPS is commercially available under the brand name RYTON. Also, the herringbone woven fabric surface of the tape of the present invention provides excellent yarn traction in longer heat tunnels.

As shown in FIGS. 3 and 4, the design of the textile structure for the counter band tape of the present invention consists of a woven fabric made up of warp and weft yarns interlaced in a balanced construction using a twill weave pattern. The warp and weft yarns, which are the two primary components of a biaxial fabric, may be of a linear mass density that is appropriate to the weave geometry and the fabric density suited to the application.

A twill weave pattern is characterized by the ribs/grooves that run diagonally across the face and the back of the fabric. A 2/2 twill weave fabric is represented by yarn floats of 2 over 2 yarns (i.e., each warp and weft yarn floats over two ends at a time at the yarn crossovers).

In a plain twill weave fabric, the diagonal twill line runs right to left or left to right, and it maintains the same direction. Depending on the direction of the diagonal twill line, the twill weave is defined as either a left hand twill weave or a right hand twill weave. In the reverse twill weave, however, the direction of the twill diagonal lines reverse repeatedly after some fixed intervals. The continuing reversal of the twill line creates a zigzag pattern with sharp pointed intersections where the diagonal lines intersect. When the intersecting twill lines meet at a point, the weave is classified as pointed twill weave (FIG. 3) and if the intersecting twill lines are offset at the meeting point, the weave is classified as herringbone twill weave (FIG. 4).

Turning to FIG. 3, Unit Cell: An 8-end weave unit cell is represented by interlacing of warps W1 through W8 and wefts S1 through S4. Symbol "X" denotes warp yarn is visible or is above the weft yarn on the face of the fabric. A blank cell denotes the weft yarn is visible or above the warp yarn on the face of the fabric. The two yarn floats are easily discernible by groupings of the X's or spaces in the unit cell. To achieve the weave pattern geometry as defined by the unit cell, the sequence of drawing warp ends (Draw Order) and the sequence of lifting the heald shafts (Lifting Order) as given in FIG. 3 must be followed.

Draw Order: The box shown below the unit cell represents the sequence of warp end drawing in the heddles (healdshafts). The sequence begins with 1$^{st}$ warp end W1 drawn in healdshaft #1 (H1). The second warp end W2 is drawn through a heddle on healdshaft #2 (H2). The third W3 and fourth W4 ends are drawn through H3 and H4 respectively. The fifth warp end W5 is drawn through healdshaft #2 (H2); the sixth warp end W6 is drawn through healdshaft #1 (H1); the seventh warp end W7 is drawn through healdshaft #4 (H4); and the eighth warp end W8 is drawn through healdshaft #3 (H3). The same sequence of draw is repeated every eight ends.

Lifting Order: The small box on the right side represents the sequence that must be followed to lift the harnesses when picks are inserted.

When the first pick S1 is inserted the healdshafts H1 and H4 must be 'Up' (i.e., these form the top shed) and healdshafts H2 and H3 must be 'Down' (i.e., these form the bottom shed).

When second pick S2 is inserted the healdshafts H1 and H2 must be in the 'Up' position and healdshafts H3 and H4 must be 'Down'.

When third pick S3 is inserted the healdshafts H2 and H3 must be in the 'Up' position and healdshafts H1 and H4 must be 'Down'.

When fourth pick S4 is inserted the healdshafts H3 and H4 must be in the 'Up' position and healdshafts H1 and H2 must be 'Down'.

Turning to FIG. 4, Unit Cell: Geometry of a unit cell for a herringbone is slightly different than the geometry of the pointed twill weave unit cell. The first half of both weave designs is quite similar. Interlacing between warp ends W5-W8 and wefts S1-S4 is however different between the two designs.

The lifting order used in both patterns is the same and therefore the cam pattern and sequence of lifting remains the same. However, in the drawing order, warp ends W5-W8 are drawn differently resulting in weave pattern differentiation.

To achieve the weave pattern geometry as defined by the unit cell, the sequence of drawing warp ends (Draw Order) and the sequence of lifting the heald shafts (Lifting Order) as given in FIG. 4 must be followed.

Counterband tapes are typically spliced for endless use and have an aspect ratio of greater than 100:1 between their length and width. Typically, the tapes are single layer narrow plain woven fabrics. To allow for quick heat and moisture absorption during the heat cycle and rapid dissipation during cooling off, the planar textile assembly must be permeable and lightweight. To permit easy flexing around the pulleys in the tunnel and also around deflection rollers for the guiding mechanism, the counterband tape should have low flexural rigidity.

As an alternative to the woven counterband tape described above, a nonwoven counterband tape may be constructed as follows. A woven reinforcement member of sufficient strength and weight is constructed from polyphenylene sulfide warp and weft yarns. Next, polyphenylene sulfide staple fibers are attached evenly to both faces of the woven reinforcement through mechanical entanglement (i.e., needle punching process). The fibrous assembly thus formed is also called a nonwoven fabric. The nonwoven fabric assembly is then heat set for enhancing its dimensional stability. The heat-setting process uses thermal/IR heat and mechanical force to achieve desired results.

The nonwoven assembly may then be calendered or pressed to achieve desired thickness and compactness as suited to meet the requirements for the end use.

An example of a woven counterband tape made with PPS fibers is provided in the following table. The tape properties outlined in the table are merely exemplary as the counterband tape specifications may vary from the outlined values for optimum performance.

| Properties | Specifications |
|---|---|
| Nominal width(mm) | 178 ± 2.7 mm<br>209 ± 2.7 mm<br>248 ± 2.7 mm |
| Nominal thickness (mm) | 1.7 ± 0.2 |
| Mass (grams/m$^2$) | 800 ± 100 |
| Admissible operating temperature | 0° C. to 163° C. |
| Tape constitution | 100% polyphenylene sulfide |

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A counterband tape designed to have length and width dimensions to fit a continuous carpet yarn heat setting system and configured to be placed over yarns to hold a layer of the yarns in position on a top surface of a belt as the yarns are conveyed through a heat setting tunnel of the carpet yarn heat setting system, the counterband tape comprising:

a web comprising polyphenylene sulphide;

wherein the web is formed by a plurality of warp and weft yarns comprising polyphenylene sulphide, the weft yarns being woven with the warp yarns in a twill weave pattern, a matt weave pattern, a warp rib weave pattern, or a weft rib weave pattern; and wherein the web is configured to absorb moisture;

wherein the web is compressible under nip pressure, exerted by nip roller assemblies of the carpet yarn heat setting system, and is expandable after nip pressure is released;

wherein the web is pre-heatset to substantially maintain a dimensional stability; and wherein the counterband tape is permeable and configured for heat and moisture absorption during a heat cycle in the heat setting tunnel and configured to dissipate heat and moisture outside of the heat cycle.

2. The counterband tape of claim 1 wherein the warp and weft yarns are woven to form a plurality of rows disposed in a machine direction, the rows having a plurality of diagonal grooves formed therein, the diagonal grooves of a first row being relatively oriented at an equal and opposite angle of the diagonal grooves of an adjacent row to form a zig zag pattern.

3. The counterband tape of claim 1, wherein the warp and weft yarns are woven in a 2/2 pointed twill weave.

4. The counterband tape of claim 1, wherein the warp and weft yarns are woven in a 2/2 herringbone twill weave.

5. The counterband tape of claim 1, wherein the web is spliced for endless use and has a length to width aspect ratio of greater than 100:1.

6. The counterband tape of claim 5, wherein the web has a flexural rigidity such that it flexes around pulleys in the heat setting tunnel and around deflection rollers.

* * * * *